United States Patent [19]

Domke

[11] 4,140,159

[45] Feb. 20, 1979

[54] APPARATUS FOR FLUSHING AIR FROM CONTAINERS

[75] Inventor: Klaus Domke, Ditzingen, Fed. Rep. of Germany

[73] Assignee: Robert Bosch GmbH, Stuttgart, Fed. Rep. of Germany

[21] Appl. No.: 777,174

[22] Filed: Mar. 14, 1977

[30] Foreign Application Priority Data

Mar. 26, 1976 [DE] Fed. Rep. of Germany ..... 2612958

[51] Int. Cl.[2] ..... B65B 31/04

[52] U.S. Cl. ..... 141/129; 53/110; 141/70; 141/285; 53/510

[58] Field of Search ..... 53/7, 11, 22 R, 22 B, 53/110, 112 R, 112 B; 141/4, 48, 63, 70, 129, 285

[56] References Cited

U.S. PATENT DOCUMENTS

| | | | |
|---|---|---|---|
| 2,768,487 | 10/1956 | Day et al. | 53/110 X |
| 4,027,450 | 6/1977 | Chiu et al. | 53/110 X |

*Primary Examiner*—Travis S. McGehee

*Attorney, Agent, or Firm*—Edward E. Sachs

[57] ABSTRACT

Air is flushed from containers by surrounding the container open tops with a layer of flushing gas and directing a high velocity jet of flushing gas downwardly through the layer into the open top containers.

6 Claims, 3 Drawing Figures

APPARATUS FOR FLUSHING AIR FROM CONTAINERS

The invention relates generally to flushing air from containers and, more particularly, to flushing air from containers by displacing same with a flushing gas.

It is known to flush air from packaging containers before the containers are filled with the material to be packaged therein. One prior arrangement is disclosed in German specification No. 2,228,056 and includes a container conveying device which operates intermittently. It is also known to flush air from the uppermost portion of containers after the containers have been substantially filled with the material to be packaged therein. One arrangement of this type is disclosed in U.S. Pat. No. 2,240,655 issued May 6, 1941, to Kronquest. In the arrangement of this patent, a flat plate having flushing gas outlets is positioned just above moving containers. A device for supplying flushing gas is located above the plate in line with the gas outlets. The gas outlets are arranged along the path of container movement in such a manner that only around one-half of each container opening is aligned with the gas outlets. This produces a flow of flushing gas in the spaces at the top of the containers which is substantially horizontal and perpendicular to the direction of container movement. The apparatus is not very suitable for flushing air from empty containers. Another arrangement for flushing a relatively samll space at the top of screw cap jars is disclosed in U.S. Pat. No. 2,768,487 issued Oct. 30, 1956 to Day et al. A plate having a plurality of small gas outlets arranged closely together is positioned above the fill openings of the screw cap jars. A flushing gas distributor is located above the plate for supplying flushing gas through the gas outlets. The apparatus is unsuitable for flushing air from empty containers because the amount of air to be flushed from an empty container is substantially greater than the amount of air to be flushed from the space remaining at the top of a container which has already been substantially filled with the material to be packaged therein.

It is therefore the primary object of the present invention to provide an apparatus and method for thoroughly flushing air from empty containers.

It is a further object of the present invention to provide an improved apparatus and method for flushing air from empty containers by introducing a high velocity jet of flushing gas into the containers while surrounding the container open tops with a layer of flushing gas to prevent air from being pulled into the containers with the jet of flushing gas.

It is another object of the present invention to provide an improved apparatus and method for flushing air from empty containers while the containers travel at a constant velocity past the flushing apparatus.

An aspect of the present invention resides in conveying open top containers past a flushing apparatus positioned above the container open tops. The flushing apparatus includes flushing gas distributing means for developing and maintaining a substantially uniformly distributed relatively low pressure flushing gas layer surrounding the container open tops. The distributing means further includes jet means for directing at least one high velocity flushing gas jet downwardly through the flushing gas layer into the containers through their open tops.

In a preferred arrangement, the flushing gas distributing means includes separate flushing gas distributing devices for the flushing gas layer and for the flushing gas jet. This makes it possible to vary the velocity of the flushing gas jet independently of the flushing gas layer, and also makes it possible to vary somewhat the vertical extent of the flushing gas layer.

The container open tops have a predetermined dimension parallel to the direction of container movement, and the flushing gas jet means includes a plurality of gas jet devices spaced-apart in the direction of container movement a distance greater than the predetermined dimension. This means that each container moves completely past one high velocity jet of flushing gas before another gas jet is introduced into the container. More thorough displacement of the air from the containers is accomplished by this arrangement.

The flushing gas jet is preferably elongated transversely to the direction of container movement so it extends completely across the containers perpendicular to their movement direction. This transverse elongation of the high velocity jet of flushing gas may be accomplished by locating a plurality of side-by-side flushing gas outlet openings perpendicular to the direction of container movement.

The flushing gas distributing means includes a distribution chamber having a downwardly facing substantially flat bottom with a plurality of closely positioned and substantially uniformly distributed small openings therethrough. Flushing gas supplied to the distribution chamber flows through the samll openings to develop and maintain the flushing gas layer. The flushing gas layer preferably extends below the edges of the container top openings so the open tops of the containers are completely surrounded by the flushing gas layer. The jet means may include at least one jet opening in the bottom of the distribution chamber and the jet opening is larger than the small openings through which flushing gas flows to develop the flushing gas layer. Separate distributing devices are preferably used for distributing flushing gas to the distribution chamber and to the jet openings. This makes it possible to vary the flushing gas layer and flushing gas jet independently of one another.

As a container moves past the high velocity jet of flushing gas, the jet is initially directed downwardly into the container starting with the leading edge portion of the container open top. The flushing gas jet is then deflected by the bottom of the container in such a manner that it flows generally horizontally opposite to the direction of container movement before ascending and escaping in the vicinity of the trailing edge portion of the container open top. A vortex is formed between the descending and ascending flows of flushing gas, and this vortex contains a substantial amount of air. As the container continues to move past the flushing gas jet, the vortex becomes smaller and smaller until it finally disappears when the descending part of the flow approaches the trailing edge portion of the container open top. Repeated flushing carried out in this manner very effectively eliminates all of the air and atmospheric oxygen from the containers. The high velocity jet of flushing gas is preferably directed vertically downwardly into the containers at a sufficient velocity so that the flow strikes the bottoms of the containers and is directed upwardly along the other side of the container. The relatively low pressure layer of flushing gas extends below the top edge of the container opening a sufficient distance to prevent air from being sucked into the containers by the flow of the high velocity jet.

For a better understanding of the present invention, together with other and further objects thereof, reference is had to the following description taken in connection with the accompanying drawings, and its scope will be pointed out in the appended claims.

Figure 1:
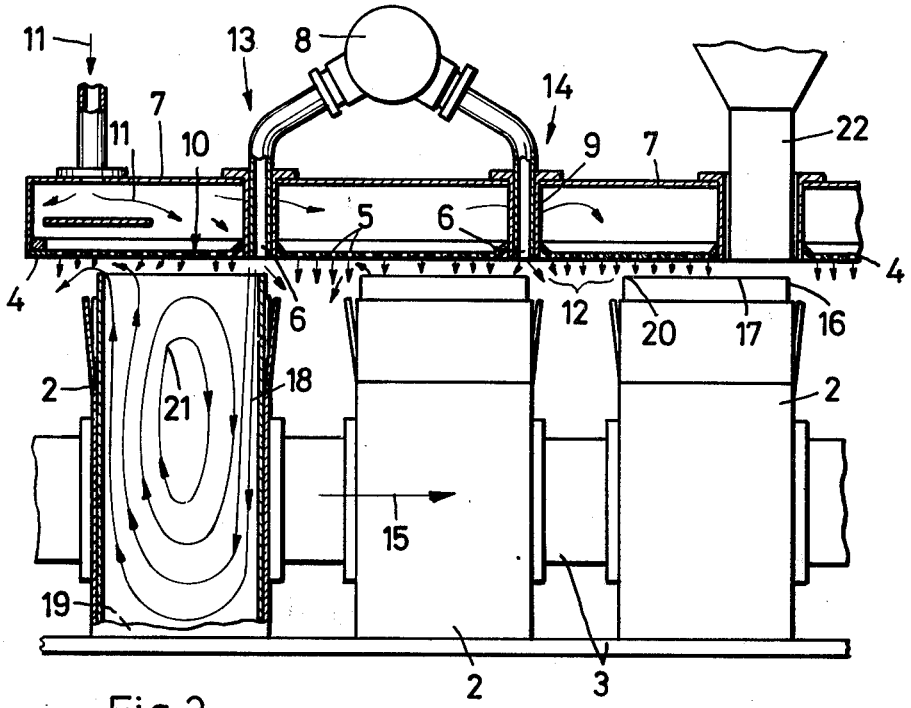
FIG. 1 is a cross-sectional side elevational view of an apparatus constructed in accordance with the present invention.

Referring now to the drawing, and particularly FIG. 1, there is shown an apparatus for flushing air from open top containers 2 and replacing such air with flushing gas containing no oxygen. The apparatus includes conveying means in the form of a conveyor 3 for conveying the containers 2 in a predetermined direction indicated by arrow 15. A flat plate 4 positioned above the conveyor 3 is located closely adjacent the container open tops and has a plurality of closely spaced uniformly distributed outlet openings 5 therein. At least one flushing gas outlet opening 6 provided in the plate 4 is of larger size than the openings 5. At least one gas distributing device is provided for supplying flushing gas through the flushing gas openings 5 and 6.

The flushing gas distributing means of the apparatus for distributing the flushing gas and flushing air from the containers 2 is located above the container open tops in FIG. 1. The distributing means includes a distributing device 7 through which flushing gas is supplied to the small openings 5 and another independent flushing gas distributing device 8 for supplying flushing gas to the larger openings 6. This arrangement makes it possible to independently adjust the velocity of the flushing gas flowing through the openings 5 and the openings 6. Flushing gas is fed to the openings 6 through pipes 9 passing through the flushing gas distributing device 7.

The flushing gas distributing device 7 may be considered a flushing gas distribution chamber into which flushing gas 11 is supplied. The flat plate 4 may be considered the bottom of the distribution chamber and may be in the form of a piece of commercial perforated board or sheet. Other material including porous foam or wire fabric may also be used for the plate 4. The plate 4 is preferably arranged approximately between 5 and 10 millimeters above open tops 10 of containers 2. As the flushing gas 11 flows from the distribution device or chamber 7 through small openings 5, a layer 12 of flushing gas is formed below the plate 4 in surrounding relationship to the container open tops 10. The layer of the flushing gas extends below the open tops 10 of the containers 2 and is at a relatively low pressure. The substantially uniformly distributed relatively low pressure layer 12 of flushing gas completely displaces the air between the plate 4 and the containers 2 to a point below the open tops 10 of the containers.

Figure 2:
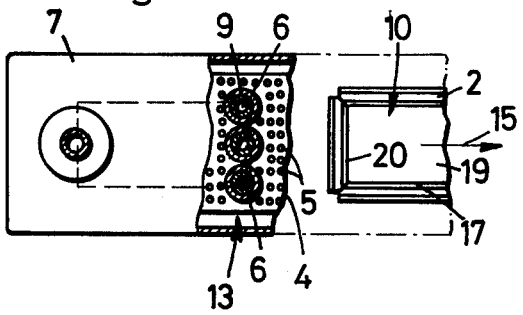
FIG. 2 is a partial top plan view of the apparatus shown in FIG. 1.

The flushing gas openings 6 may be considered flushing gas jet means for directing a high velocity flushing gas jet downwardly through flushing gas layer 12 into the open tops 10 of the containers 2. The jet means includes gas jet devices 13 and 14 spaced-apart from one another in the direction of container movement. The container open tops 10 may be considered as having a predetermined dimension parallel to the direction of container movement 15, and the gas jet devices 13 and 14 are spaced from one another in the direction 15 a distance greater than the predetermined dimension. This means that a given container 2 will move completely past one gas jet device 13 before another gas jet is introduced into that same container through the gas jet device 14. As best shown in FIG. 2, the gas jet extends transversely at right angles to the direction of container movement completely across each open top 10 of each container 2. In the arrangement shown, this is accomplished by locating a plurality of side-by-side large gas jet devices or openings 6 perpendicular to direction 15 of container movement. The containers 2 are shown as being substantially rectangular and sufficient openings 6 are provided to produce a jet extending completely across each container. The gas jet openings 6 are arranged so that the gas jet formed has a width perpendicular to the direction of container movement 15 which is substantially greater than the length of the jet parallel to the direction 15. In other words, the length of each open top on a container 2 is substantially greater parallel to the direction 15 than the length of the flushing gas jet parallel to the direction 15.

Figure 3:
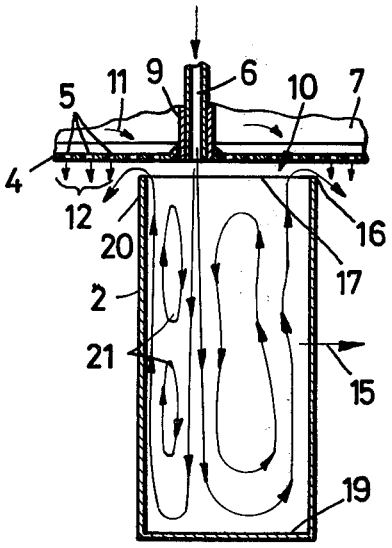
FIG. 3 is a partial cross-sectional side elevational view similar to FIG. 1 and showing a container just prior to the end of a flushing operation.

As the containers 2 move along in the direction 15 at a uniform constant velocity, the leading portion 16 of edge 17 for each open top 10 is first to arrive under a flushing gas jet or opening 6. At this time, there is a flow 18 of flushing gas which descends vertically downwardly into the container. This flow of flushing gas is then deflected generally horizontally along the bottom 19 of the container in a direction opposite to the direction 15. The flow then ascends generally vertically upwardly to the trailing edge portion 20 of the edge 17 on the open top 10. The flow described from the gas jet through openings 6 forms a vortex 21 between the descending and ascending flows. At first, this vortex contains a relatively large amount of air, and therefore a large amount of oxygen. However, as the containers 2 move along in the direction 15, the leading portions 16 of edges 17 on open tops 10 move away from jet openings 6 and trailing portions 20 of the open tops approach the jet openings 6. During this movement of the containers, the vortex indicated generally at 21 in FIG. 1 descreases in size parallel to the direction 15 in the general manner shown at 21 in FIG. 3 until the vortex finally disappears.

It has been found that the flushing arrangement of the present application results in a remarkably effective removal of air and its accompanying oxygen from the containers 2. This is particularly true when the flushing operation is repeated several times.

The layer 12 of flushing gas surrounding the container open tops insures that the high velocity jets flowing through openings 6 do not draw any atmosphere containing oxygen into the containers 2. After the flushing operation with the high velocity jet of flushing gas, the layer 12 insures that the containers 2 remain filled with flushing gas and blocks entry of oxygen containing air to the containers as they move to a filling device 22 of conventional construction for filling the containers 2 with a material to be packaged therein.

While there has been described what is at present considered to be the preferred embodiment of this invention, it will be obvious to those skilled in the art that various changes and modifications may be made therein without departing from the invention, and it is aimed, therefore, in the appended claims to cover all such changes and modifications as fall within the true spirit and scope of the invention.

Having thus described my invention, I claim:

1. Apparatus for flushing containers with flushing gas comprising:

conveying means for conveying open top containers past a flushing apparatus positioned above the containers' open tops, said flushing apparatus including flushing gas distributing means for developing and maintaining a substantially uniformly distributed flushing gas layer surrounding the containers' open tops during conveyance of the containers, said distributing means comprising a distribution chamber having a downwardly facing substantially flat bottom with a plurality of substantially uniformly distributed small openings therethrough for developing and maintaining said flushing gas layer, and said plate further containing at least one large opening for establishing jet means to direct at least one high velocity flushing gas jet downwardly through said flushing gas layer into the containers through their open tops, the opening of the jet means being comparatively larger than the opening of said small openings;

and means to independently adjust the relative stream velocity of the gas passing through the large and small openings.

2. The apparatus of claim 1 wherein said flushing gas distributing means includes separate flushing gas distributing devices for said flushing gas layer and for said flushing gas jet.

3. The apparatus of claim 1 wherein the container open tops have a predetermined dimension parallel to the direction of container movement and said flushing gas jet means includes a plurality of gas jet devices spaced-apart in the direction of container movement a distance greater than said predetermined dimension.

4. The apparatus of claim 1 wherein said flushing gas jet is elongated transversely of the direction of container movement.

5. The apparatus of claim 1 wherein said jet means includes a plurality of outlets extending transversely of the direction of container movement for directing a plurality of high velocity flushing gas jets downwardly across the container open tops.

6. The apparatus of claim 1 wherein said distributing means includes separate distributing devices for distributing flushing gas to said chamber and to said jet opening.

* * * * *